US007812663B2

(12) United States Patent
Lee et al.

(10) Patent No.: US 7,812,663 B2
(45) Date of Patent: Oct. 12, 2010

(54) BANDGAP VOLTAGE REFERENCE CIRCUIT

(75) Inventors: Tzuen-Hwan Lee, Tai-Chung Hsien (TW); Ching-Chuan Lin, Taipei (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 0 days.

(21) Appl. No.: 12/325,256

(22) Filed: Nov. 30, 2008

(65) Prior Publication Data

US 2009/0261895 A1 Oct. 22, 2009

(30) Foreign Application Priority Data

Apr. 21, 2008 (TW) ..... 97114473 A

(51) Int. Cl.
*G05F 1/10* (2006.01)
*G05F 3/02* (2006.01)

(52) U.S. Cl. ..... 327/538; 327/540; 327/541; 327/543; 323/313; 323/316

(58) Field of Classification Search ..... None
See application file for complete search history.

(56) References Cited

U.S. PATENT DOCUMENTS 6,075,407 A * 6/2000 Doyle ..... 327/539
6,563,371 B2 * 5/2003 Buckley et al. ..... 327/539
7,411,380 B2 * 8/2008 Chang et al. ..... 323/314
7,495,505 B2 * 2/2009 Chang et al. ..... 327/539
7,570,107 B2 * 8/2009 Kim et al. ..... 327/539
2005/0206443 A1 * 9/2005 Chatal et al. ..... 327/538
2008/0042737 A1 * 2/2008 Kim et al. ..... 327/539
2009/0174468 A1 * 7/2009 Yoshida et al. ..... 327/539
2009/0189591 A1 * 7/2009 Sperling et al. ..... 323/315

* cited by examiner

*Primary Examiner*—Tuan Lam
(74) *Attorney, Agent, or Firm*—Winston Hsu; Scott Margo; Min-Lee Teng

(57) ABSTRACT

A bandgap voltage reference circuit includes an operational amplifier, a first transistor, a second transistor, a third transistor, a first resistor, a second resistor, a first diode, a second diode, and a divider. The first transistor, the second transistor, and the third transistor form current mirrors. The reference current of the current mirrors is generated according to the first diode, the second diode, and the first resistor. The reference voltage of the voltage reference circuit is output from the first end of the second resistor. The divider is coupled to the second end of the second resistor so that the reference voltage of the voltage reference circuit can be reduced.

9 Claims, 5 Drawing Sheets

BANDGAP VOLTAGE REFERENCE CIRCUIT

BACKGROUND OF THE INVENTION

1. Field of the Invention

The present invention relates to a voltage reference generator, and more particularly, to a low voltage bandgap reference circuit.

2. Description of the Prior Art

The voltage reference generator is an essential design block generally needed in analog and mixed circuits. It typically uses a bandgap reference circuit to generate a reference voltage that is relatively insensitive to the temperature and the supply voltage. The reference voltage output of the bandgap reference circuit according to the prior art is about 1.2V that is roughly equal to silicon bandgap energy measured at 0K in electron volts. Thus, the required supply voltage is at least 1.4V or higher.

The base-emitter voltage of the bipolar junction transistor (BJT) and the voltage difference between the base and the emitter of two BJTs are main factors determining the reference voltage. The base-emitter voltage has a negative temperature coefficient; that is, the base-emitter voltage decreases as the temperature increases. On the other hand, the voltage difference between the base and the emitter has a positive temperature coefficient; that is, the voltage difference between the base and the emitter increases as the temperature increases. To prevent the reference voltage varying as the temperature, the voltage difference between the base and the emitter is adjusted and added to the base-emitter voltage.

Please refer to FIG. 1. FIG. 1 is a schematic diagram of a bandgap reference circuit 10 according to the prior art. The bandgap reference circuit 10 includes an operation amplifier OP0, two transistors M0 and M1, and two resistors R0 and R1. In complementary metal oxide semiconductor (CMOS) process, the parasitic diodes can be formed with the vertical junction p+/n-well/p-sub of the bipolar transistor having the collector and the base connected to the ground. The base-emitter voltage of a forward active operation diode can be expressed as:

$$Vbe=Vt*\ln(Ic/Is)$$

$$Vt=kT/q$$

Where Ic is the collector current, Is is the saturation current, k is Boltzmann constant, T is temperature, q is electron charges, and Vt is the thermal voltage. Vt is about 26 mV at room temperature (~300K).

The voltage across the resistor R0 is the voltage difference between the voltage Vbe1 and Vbe0, which can be expressed as:

$$\Delta Vbe=Vbe1-Vbe0=Vt*\ln(n)$$

Where Vbe1 is the base-emitter voltage of the diode Q1, Vbe is the base-emitter voltage of the diode Q0. When the diode Q1 is n times the size of the diode Q2, the current through the resistor R1 is the same as that through the resistor R0. The output reference voltage can be expressed as:

$$Vref = Vbe1 + R1*\frac{Vt*\ln(n)}{R0} = Vbe1 + Vt*M$$

The base-emitter voltage typically has a value of 0.6V and a negative temperature coefficient of −2 mV/K (complementary to absolute temperature, CTAT). The thermal voltage has a positive temperature coefficient of +0.085 mV/K (proportional to absolute temperature, PTAT). Thus, the output reference voltage can be insensitive to the temperature. When M=23, the reference voltage is about 0.6V+23*26 mV~1.2V.

However, the bandgap reference circuit 10 according to the prior art in FIG. 1 cannot be applied in the low supply voltage applications or be implemented by the deep submicron CMOS device where the power supply VDD is less than 1.2V. Thus, the prior art provides a low voltage bandgap reference circuit. Please refer to FIG. 2. FIG. 2 is a schematic diagram of a low voltage bandgap reference circuit 20 according to the prior art. The bandgap reference circuit 20 includes an operation amplifier OP0, three transistors M0, M1 and M2, four resistors R0, R1*a*, R1*b* and R2, and two diodes Q0 and Q1. The output reference voltage can be expressed as:

$$\begin{aligned} Vref &= R2*(ICTAT + IPTAT) \\ &= R2*\left(\frac{Vbe1}{R1a} + \frac{Vt*\ln(n)}{R0}\right) \\ &= \frac{R2}{R1a}*\left(Vbe1 + R1a*\frac{Vt*\ln(n)}{R0}\right) \\ &\sim \frac{R2}{R1}*1.2\ \text{V} \end{aligned}$$

In conclusion, the bandgap reference circuit can provide a stable output voltage insensitive to the temperature and the supply voltage. The output reference voltage of the bandgap reference circuit according to the prior art is about 1.2V, so the required supply voltage VDD is at least 1.4V or higher. However, in the deep submicron CMOS device where the power supply VDD is less than 1.2V, the low voltage bandgap reference circuit is used.

SUMMARY OF THE INVENTION

According to an embodiment of the present invention, a bandgap voltage reference circuit comprises a first operational amplifier, a first transistor, a second transistor, a third transistor, a first resistor, a second resistor, a first diode, a second diode, and a divider. A gate of the first transistor is coupled to an output end of the first operational amplifier. A source of the first transistor is coupled to a power supply. A drain of the first transistor is coupled to a positive input end of the first operational amplifier. A gate of the second transistor is coupled to the output end of the first operational amplifier. A source of the second transistor is coupled to the power supply. A drain of the second transistor is coupled to a negative input end of the first operational amplifier. A gate of the third transistor is coupled to the output end of the first operational amplifier. A source of the third transistor is coupled to the power supply. A first end of the first resistor is coupled to the positive input end of the first operational amplifier. A first end of the second resistor is coupled to a drain of the third transistor. A first end of the first diode is coupled to a second end of the first resistor. A second end of the first diode is coupled to a ground. A first end of the second diode is coupled to the negative input end of the first operational amplifier. A second end of the second diode is coupled to the ground. An input end of the divider is coupled to the negative input end of the first operational amplifier. An output end of the divider is coupled to a second end of the second resistor.

According to another embodiment of the present invention, a bandgap voltage reference circuit comprises a first operational amplifier, a first MOS transistor, a second MOS transistor, a third MOS transistor, a first resistor, a second resistor, a first BJT, a second BJT, a second operational amplifier, and a third resistor. A gate of the first MOS transistor is coupled to an output end of the first operational amplifier. A source of the first MOS transistor is coupled to a power supply. A drain of the first MOS transistor is coupled to a positive input end of the first operational amplifier. A gate of the second MOS transistor is coupled to the output end of the first operational amplifier. A source of the second MOS transistor is coupled to the power supply. A drain of the second MOS transistor is coupled to a negative input end op the first operational amplifier. A gate of the third MOS transistor is coupled to the output end of the first operational amplifier. A source of the third MOS transistor is coupled to the power supply. A first end of the first resistor is coupled to the positive input end of the first operational amplifier. A first end of the second resistor is coupled to a drain of the third MOS transistor. A collector the first BJT is coupled to the second end of the first resistor. An emitter of the first BJT is coupled to a ground. A base of the first BJT is coupled to the emitter of the first BJT. A collector of the second BJT is coupled to the negative input end of the first operational amplifier. An emitter of the second BJT is coupled to the ground. A base of the second BJT is coupled to the emitter of the second BJT. A positive input end of the second operational amplifier is coupled to the negative input end of the first operational amplifier. A negative input end of the second operational amplifier is coupled to an output end of the second operational amplifier. The output end of the second operational amplifier is coupled to a second end of the second resistor. A first end of the third resistor is coupled to the first end of the second resistor. A second end of the third resistor is coupled to the ground.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
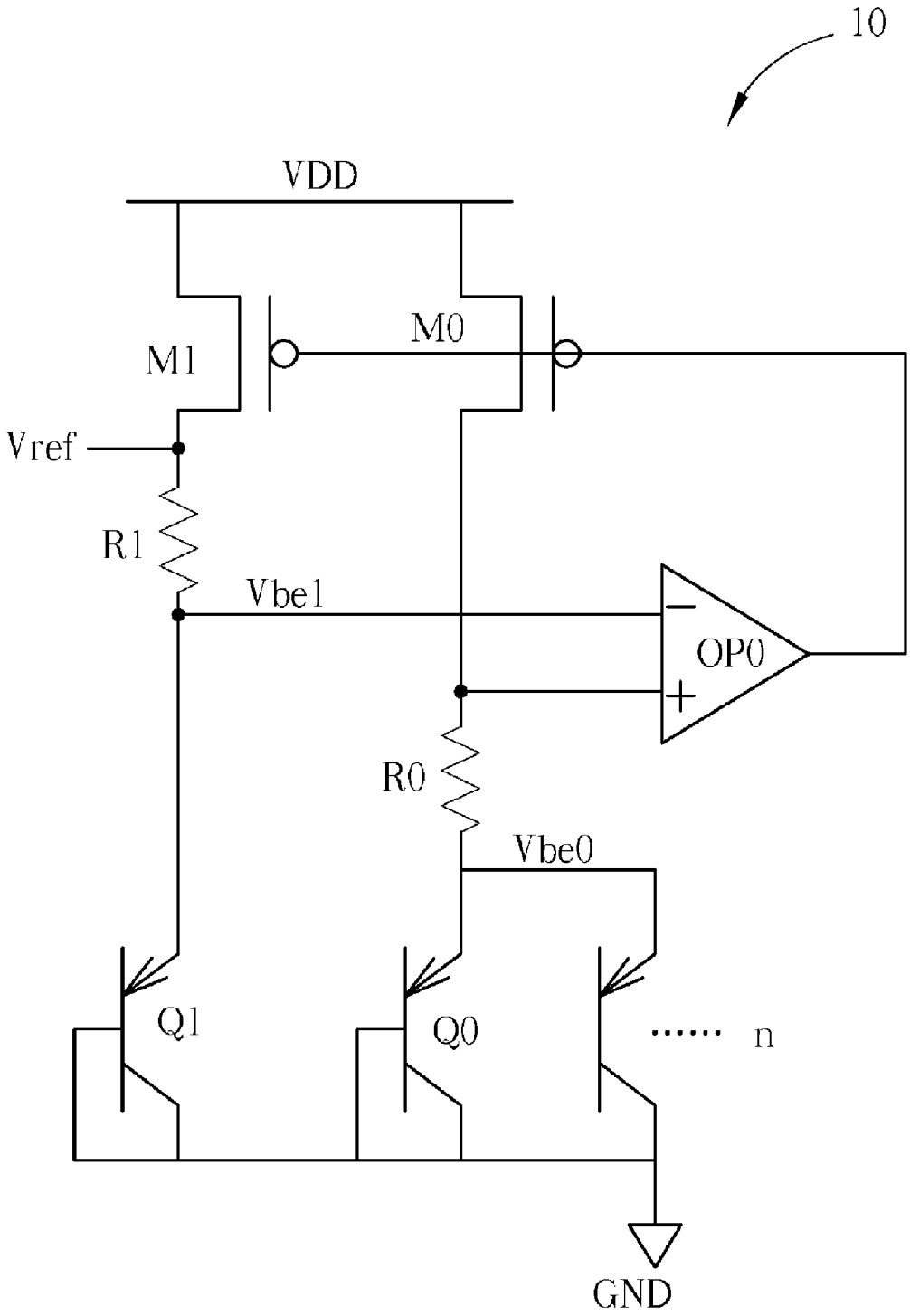
FIG. 1 PRIOR ART
FIG. 1 is a schematic diagram of a bandgap reference circuit according to the prior art.
Figure 2:
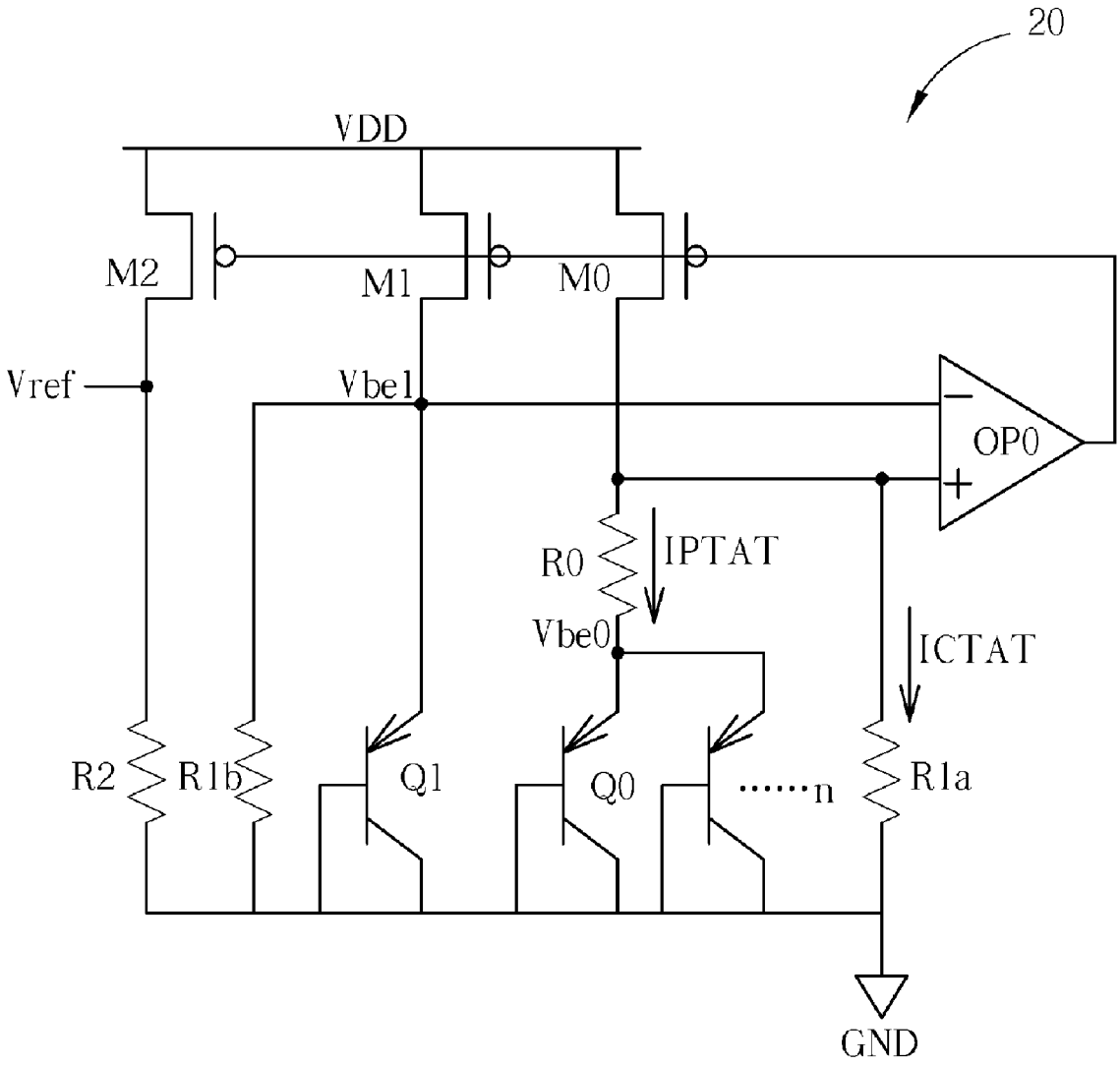
FIG. 2 PRIOR ART
FIG. 2 is a schematic diagram of a low voltage bandgap reference circuit according to the prior art.
Figure 3:
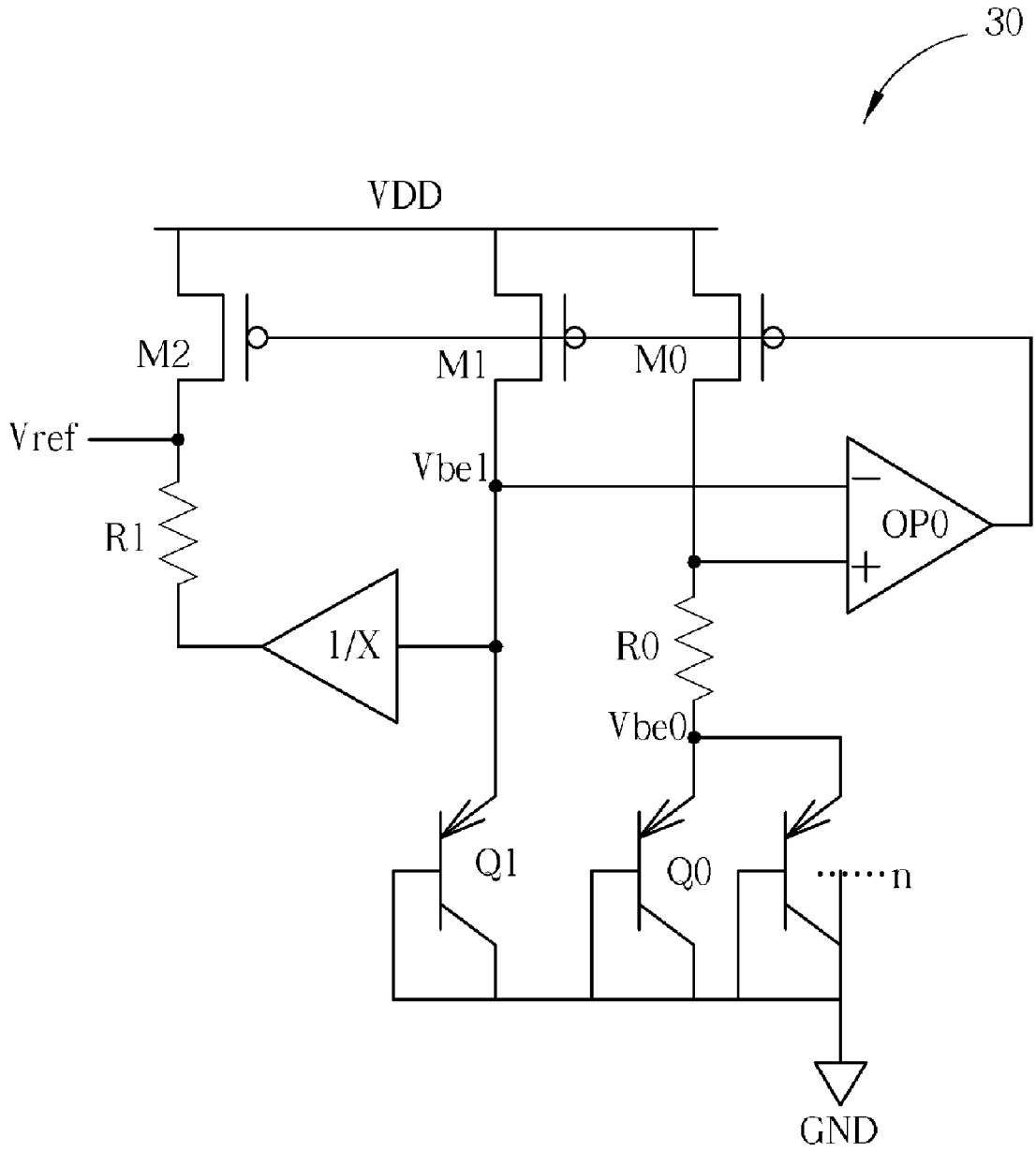
FIG. 3 is a schematic diagram of a bandgap reference circuit according to the present invention.

Please refer to FIG. 3. FIG. 3 is a schematic diagram of a bandgap reference circuit 30 according to the present invention. The bandgap reference circuit 30 can operate at the supply voltage VDD about 1V or lower. The reference circuit 30 comprises a first operational amplifier OP0, a first transistor M0, a second transistor M1, a third transistor M2, a first resistor R0, a second resistor R1, a first diode Q0, a second diode Q1, and a divider 1/X. The gate of the first transistor M0 is coupled to the output end of the first operational amplifier OP0. The source of the first transistor M0 is coupled to a power supply VDD. The drain of the first transistor M0 is coupled to the positive input end of the first operational amplifier OP0. The gate of the second transistor M1 is coupled to the output end of the first operational amplifier OP0. The source of the second transistor M1 is coupled to the power supply VDD. The drain of the second transistor M1 is coupled to the negative input end of the first operational amplifier OP0. The gate of the third transistor M2 is coupled to the output end of the first operational amplifier OP0. The drain of the third transistor M2 is coupled to the power supply VDD. The source of the third transistor M2 is coupled to the first end of the second resistor R1. The first end of the first resistor R0 is coupled to the positive input end of the first operational amplifier OP0. The first end of the first resistor R0 is coupled to the first end of the first diode Q0. The second end of the first diode Q0 is coupled to the ground GND. The first end of the second diode Q1 is coupled to the negative input end of the first operational amplifier OP0. The second end of the second diode Q1 is coupled to the ground GND. The input end of the divider 1/X is coupled to the negative input end of the first operational amplifier OP0. The output end of the divider 1/X is coupled to the second end of the second resistor R1. The first transistor M0, the second transistor M1, and the third transistor M2 are P-type MOS transistors. The first diode Q0 and the second diode Q1 are formed with a PNP bipolar junction transistor (BJT) respectively, where the collector of the BJT is coupled to the base of the BJT.

The reference circuit 30 of the present invention utilizes the divider 1/X to reduce the output reference voltage Vref, so that the reference circuit 30 can use the lower power supply VDD. The output reference voltage Vref of the reference circuit 30 is analyzed as below. Firstly, the first transistor M0, second transistor M1, and the third transistor M2 form current mirrors, so the drain currents of the third transistor M2P and the second transistor M1 are equal to the drain current of the first transistor MP0. The reference current can be expressed as $$\frac{Vbe1 - Vbe0}{R0}$$

at the drain of the first transistor MP0 because of virtual short between the positive input end and the negative input end of the first operational amplifier OP0. When the diode Q1 is n times the size of the diode Q2, the reference current is equal to $$\frac{Vt * \ln(n)}{R0}.$$

In addition, the output end Vout and the input end Vin of the divider 1/X have an equation $$Vout = \frac{Vin}{X}.$$

Thus, the output reference voltage Vref can be expressed as:

$$\begin{aligned} Vref &= \frac{1}{X} * Vbe1 + R1 * \frac{Vt * \ln(n)}{R0} \\ &= \frac{1}{X} * (Vbe1 + Vt * M) \end{aligned}$$

where M is a design parameter, when M=23, the output reference voltage Vref can be expressed as:

$$Vref = \frac{1}{X} * (0.6\ \text{V} + 23 * 26\ \text{mV}) \sim \frac{1.2\ \text{V}}{X}$$

Figure 4:
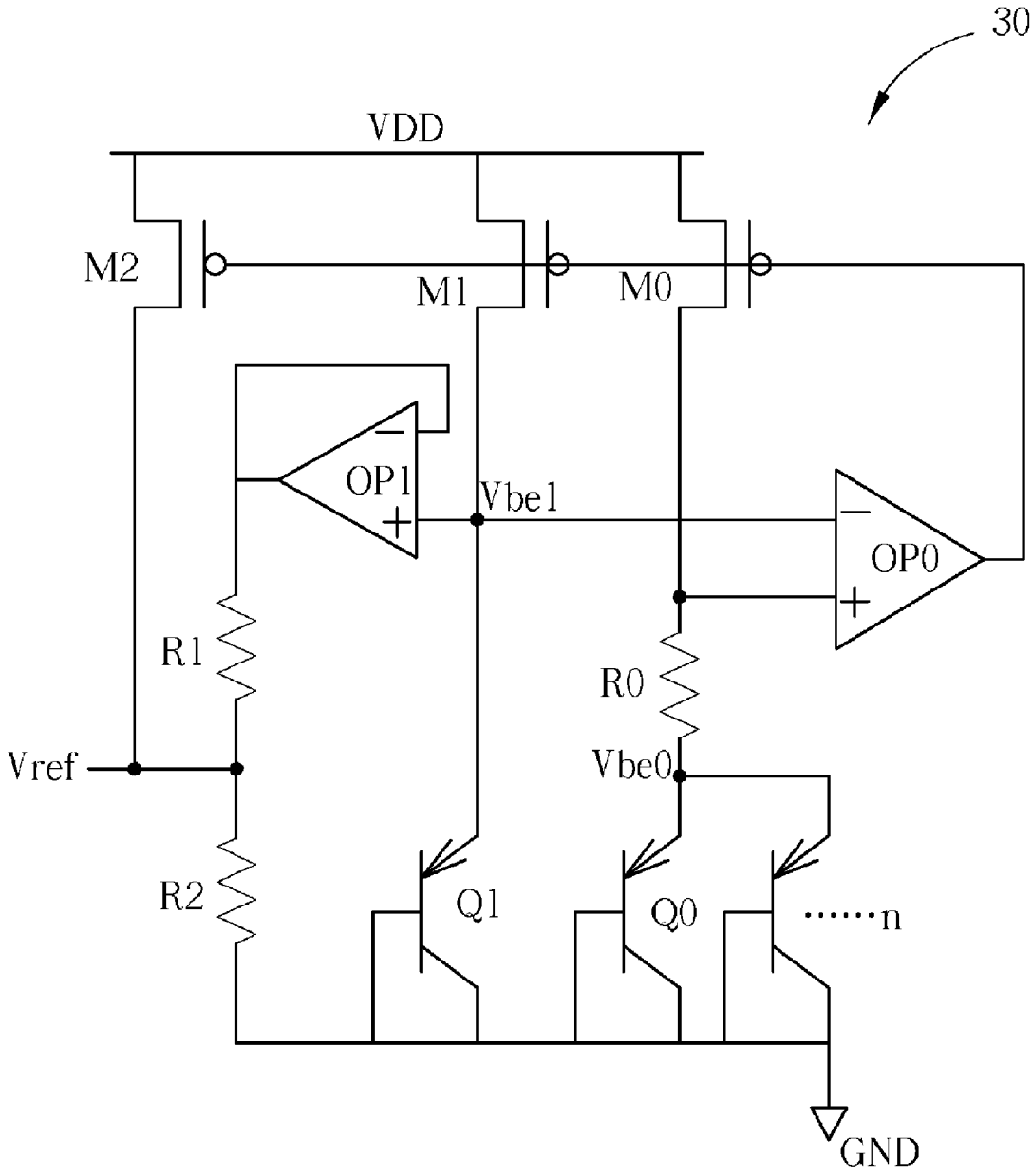
FIG. 4 is a schematic diagram of an embodiment of the reference circuit in FIG. 3.

Please refer to FIG. 4. FIG. 4 is a schematic diagram of an embodiment of the reference circuit in FIG. 3. The divider 1/X comprises a second operational amplifier OP1 and a third resistor R2. The positive input end of the second operational amplifier OP1 is coupled to the negative input end of the first operational amplifier OP0. The negative input end of the second operational amplifier OP1 is coupled to the output end of the second operational amplifier OP1. The output end of the second operational amplifier OP1 is coupled to the second end of the second resistor R1. The first end of the third resistor R2 is coupled to the first end of the second resistor R1. The second end of the third resistor R2 is coupled to the ground GND. The following equation is obtained from the node of the output reference voltage Vref.

$$\frac{Vref}{R2} = \frac{Vbe1 - Vref}{R1} + \frac{Vt * \ln(n)}{R0}$$

Thus, the output reference voltage Vref can be expressed as:

$$\begin{aligned} Vref &= \left(\frac{R1 * R2}{R1 + R2}\right) * \left(\frac{Vbe1}{R1} + \frac{Vt * \ln(n)}{R0}\right) \\ &= \frac{R2}{R1 + R2} * \left(Vbe1 + R1 * \frac{Vt * \ln(n)}{R0}\right) \\ &\sim \frac{R2}{R1 + R2} * 1.2\ \text{V} \end{aligned}$$

In this embodiment, the coefficient of the divider 1/X is corresponding to $$\frac{R2}{R1 + R2},$$

and M is corresponding to $$\frac{R1 * \ln(n)}{R0}.$$

When R2=R1 and M=23, the reference voltage Vref is about 0.6V.

Figure 5:
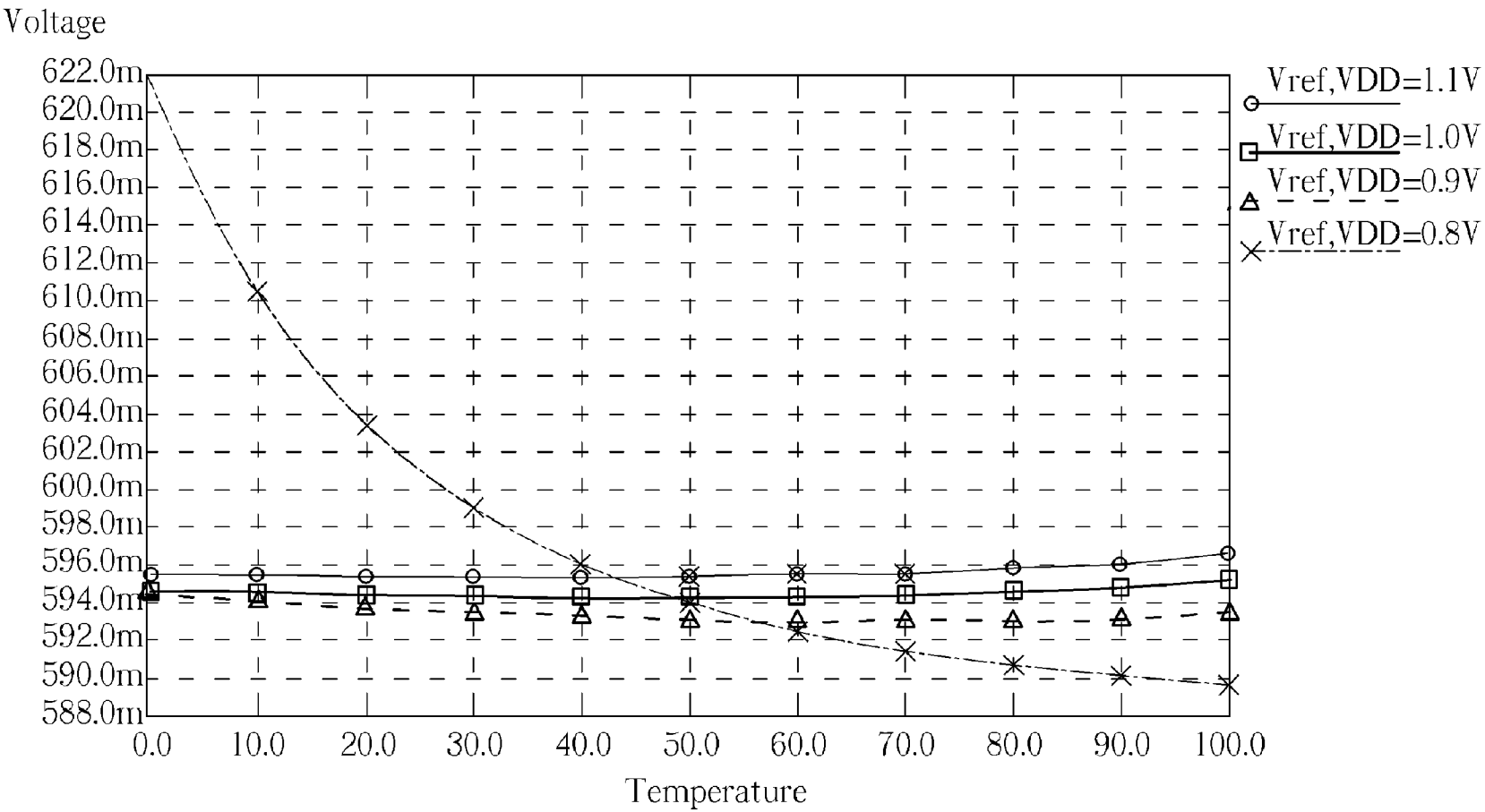
FIG. 5 is a chart of the output reference voltage Vref of the reference circuit to the temperature.

Please refer to FIG. 5. FIG. 5 is a chart of the output reference voltage Vref of the reference circuit 30 to the temperature. In FIG. 5, the X-coordinate represents the temperature, and the Y-coordinate represents the voltage. Four curves show the output reference voltage Vref from 0 degrees to 100 degrees when the power supply VDD is 0.8V, 09V, 1.0V, and 1.1V respectively. When the power supply VDD is between 1.1V and 0.9V, the output reference voltage Vref of the reference circuit 30 is between 593 mV and 597 mV from 0 degrees to 100 degrees. However, the power supply VDD drops to 0.8V, the output reference voltage Vref of the reference circuit 30 varies greatly as the temperature. Thus, the reference circuit 30 can output the stable reference voltages when the power supply VDD is between 1.1V and 0.9V.

In conclusion, the reference circuit according to the present invention utilizes the divider to reduce the output reference voltage, so that the reference circuit can use the lower power supply VDD. The bandgap voltage reference circuit comprises an operational amplifier, a first transistor, a second transistor, a third transistor, a first resistor, a second resistor, a first diode, a second diode, and a divider. The first transistor, the second transistor, and the third transistor form current mirrors. The reference current of the current mirrors is generated according to the first diode, the second diode, and the first resistor. The reference voltage of the voltage reference circuit is output from the first end of the second resistor. The divider is coupled to the second end of the second resistor so that the reference voltage of the voltage reference circuit can be reduced. Thus, the bandgap voltage reference circuit can operate in the low supply voltage.

Those skilled in the art will readily observe that numerous modifications and alterations of the device and method may be made while retaining the teachings of the invention.

What is claimed is:

1. A bandgap voltage reference circuit, comprising:

a first operational amplifier;

a first transistor, a gate of the first transistor being coupled to an output end of the first operational amplifier, a source of the first transistor being coupled to a power supply, and a drain of the first transistor being coupled to a positive input end of the first operational amplifier;

a second transistor, a gate of the second transistor being coupled to the output end of the first operational amplifier, a source of the second transistor being coupled to the power supply, and a drain of the second transistor being coupled to a negative input end of the first operational amplifier;

a third transistor, a gate of the third transistor being coupled to the output end of the first operational amplifier, and a source of the third transistor being coupled to the power supply;

a first resistor, a first end of the first resistor being coupled to the positive input end of the first operational amplifier;

a second resistor, a first end of the second resistor being coupled to a drain of the third transistor;

a first diode, a first end of the first diode being coupled to a second end of the first resistor, and a second end of the first diode being coupled to a ground;

a second diode, a first end of the second diode being coupled to the negative input end of the first operational amplifier, and a second end of the second diode being coupled to the ground; and a divider, comprising:

a second operational amplifier, a positive input end of the second operational amplifier being coupled to the negative input end of the first operational amplifier, a negative input end of the second operational amplifier being coupled to an output end of the second operational amplifier, and the output end of the second operational amplifier being coupled to the second end of the second resistor; and a third resistor, a first end of the third resistor being coupled to the first end of the second resistor, and a second end of the third resistor being coupled to the ground.

2. The voltage reference circuit of claim 1, wherein the first transistor, the second transistor, and the third transistor are P-type MOS transistors.

3. The voltage reference circuit of claim 1, wherein the first diode and the second diode are formed with a PNP bipolar junction transistor (BJT) respectively, a collector of the BJT being coupled to a base of the BJT.

4. The voltage reference circuit of claim 1, wherein the drain current of the second transistor is equal to the drain current of the third transistor.

5. The voltage reference circuit of claim 1, wherein the first end of the second resistor outputs a reference voltage.

6. A bandgap voltage reference circuit, comprising:

a first operational amplifier;

a first MOS transistor, a gate of the first MOS transistor being coupled to an output end of the first operational amplifier, a source of the first MOS transistor being coupled to a power supply, and a drain of the first MOS transistor being coupled to a positive input end of the first operational amplifier;

a second MOS transistor, a gate of the second MOS transistor being coupled to the output end of the first operational amplifier, a source of the second MOS transistor being coupled to the power supply, and a drain of the second MOS transistor being coupled to a negative input end op the first operational amplifier;

a third MOS transistor, a gate of the third MOS transistor being coupled to the output end of the first operational amplifier, and a source of the third MOS transistor being coupled to the power supply;

a first resistor, a first end of the first resistor being coupled to the positive input end of the first operational amplifier;

a second resistor, a first end of the second resistor being coupled to a drain of the third MOS transistor;

a first bipolar junction transistor (BJT), a collector the first BJT being coupled to the second end of the first resistor, an emitter of the first BJT being coupled to a ground, and a base of the first BJT being coupled to the emitter of the first BJT;

a second BJT, a collector of the second BJT being coupled to the negative input end of the first operational amplifier, an emitter of the second BJT being coupled to the ground, and a base of the second BJT being coupled to the emitter of the second BJT;

a second operational amplifier, a positive input end of the second operational amplifier being coupled to the negative input end of the first operational amplifier, a negative input end of the second operational amplifier being coupled to an output end of the second operational amplifier, and the output end of the second operational amplifier being coupled to a second end of the second resistor; and a third resistor, a first end of the third resistor being coupled to the first end of the second resistor, and a second end of the third resistor being coupled to the ground.

7. The voltage reference circuit of claim 6, wherein the drain current of the second MOS transistor and the drain current of the third MOS transistor are equal to the drain current of the first MOS transistor.

8. The voltage reference circuit of claim 6, wherein the first end of the second resistor outputs a reference voltage.

9. The voltage reference circuit of claim 8, wherein when the resistance of the second resistor is equal to the third resistor, the reference voltage is about 0.6V.

* * * * *